US009375830B2

(12) United States Patent
Kana et al.

(10) Patent No.: US 9,375,830 B2
(45) Date of Patent: Jun. 28, 2016

(54) SCREW RETENTION MECHANISM FOR SCREW DRIVERS

(71) Applicant: SpineSmith Partners, L.P., Austin, TX (US)

(72) Inventors: Richard J. Kana, Lexington, TX (US); Rodney Bud Smith, Dripping Springs, TX (US)

(73) Assignee: SpineSmith Partners, L.P., Austin, TX (US)

( * ) Notice: Subject to any disclaimer, the term of this patent is extended or adjusted under 35 U.S.C. 154(b) by 262 days.

(21) Appl. No.: 14/214,845

(22) Filed: Mar. 15, 2014

(65) Prior Publication Data

US 2014/0260833 A1 Sep. 18, 2014

Related U.S. Application Data

(60) Provisional application No. 61/798,426, filed on Mar. 15, 2013.

(51) Int. Cl.
*B25B 23/10* (2006.01)
*B25B 15/00* (2006.01)

(52) U.S. Cl.
CPC ..... *B25B 23/105* (2013.01); *B25B 15/005* (2013.01)

(58) Field of Classification Search
CPC ..... B25B 23/105; B25B 15/005
See application file for complete search history.

(56) References Cited

U.S. PATENT DOCUMENTS

| | | | | | |
|---|---|---|---|---|---|
| 3,286,749 | A * | 11/1966 | Learned | B25B 13/06 | 81/125 |
| 4,060,114 | A * | 11/1977 | Matsushima | B25B 15/005 | 81/448 |
| 6,681,662 | B2 * | 1/2004 | Blackston | B25B 23/105 | 81/436 |
| 6,684,741 | B2 * | 2/2004 | Blackston | B25B 23/105 | 81/436 |
| 7,137,322 | B2 * | 11/2006 | Mark | A61B 17/888 | 81/436 |
| 7,174,615 | B2 * | 2/2007 | Mark | A61B 17/888 | 29/270 |
| 8,347,768 | B2 * | 1/2013 | Witte | A61B 17/8888 | 81/442 |
| 8,770,068 | B2 * | 7/2014 | Witte | A61B 17/8888 | 81/442 |
| 2008/0275459 | A1 * | 11/2008 | Dickinson | A61B 17/8875 | 606/104 |

* cited by examiner

*Primary Examiner* — David B Thomas
(74) *Attorney, Agent, or Firm* — Winstead PC

(57) ABSTRACT

Embodiments of the claimed invention are directed to a screw and screw driver which provides for a screw that is held in position on the driver for use in a variety of applications including surgery, auto mechanics, carpentry or any field where a screw driver instrument could be used. After the screw is driven into place, the driver is easily released and removed from the screw.

13 Claims, 3 Drawing Sheets

SCREW RETENTION MECHANISM FOR SCREW DRIVERS

CROSS-REFERENCES TO RELATED APPLICATIONS

This Application claims the benefit under 35 U.S.C. §119 (e) of U.S. Provisional Patent Application No. 61/798,426 filed Mar. 15, 2013 which is incorporated herein by reference in its entirety as if fully set forth herein.

FIELD OF THE INVENTION

The present invention relates to a screw retention mechanism which provides for a screw that is held in position on the driver for use in a variety of applications including surgery, auto mechanics, carpentry or any field where a screw driver instrument could be used. After the screw is driven into place, the driver is easily released and removed from the screw.

BACKGROUND OF THE INVENTION

There are several available mechanisms for retaining biomedical fasteners during orthopedic surgery. One mechanism is as simple as utilizing a slight taper on the driver and/or the screw itself, creating a taper lock. This method has at least two or three inherent disadvantages. If a taper is incorporated into the screw, the screw no longer has a "standard" interface and a non-standard driver may have to be used with it. When tapers are used on either the screw or the driver, very close manufacturing tolerances are required to achieve the desired functional results. Close manufacturing tolerances translate into higher manufacturing cost. Another problem with close manufacturing tolerances of a taper is the wear introduced into the driver through use. It only requires a small amount of wear to the tapered surfaces of the driver to cause a functional failure. Taper locks sometimes have a tendency to "lock" up too well, and so the user may have difficulty disengaging the driver from the screw.

Another retention method that is currently in use involves a plastic type material that is incorporated into the tip of the driver. The plastic material protrudes slightly proud of the mating surfaces of the driver, thus creating an interference fit compared to a slip fit between the male and female driver features. The plastic material is soft enough to flow or reshape itself, thereby allowing sufficient drag to overcome the force of gravity, retaining the screw to the driver tip. This design functions well when the driver is new. However, repeated usage wears out the plastic component and, as the friction reduces, the ability to retain the screw is lost. The plastic component also can fall out of the driver, which is a serious complication when the tool is being used during a surgical procedure. Furthermore, loss of the plastic component completely eliminates the retention function of the driver.

Another form of screw retention is based on a mechanical clip or retainer element. While this design strategy is fairly reliable, they too are subject to wear and eventual failure. The main obstacle in this form of a mechanism is its physical size. Typically, the clip or retainer is attached to the driver and will grasp the head of the screw in some fashion. The extra material at the working end of the driver may obstruct or limit visibility during placement of the screw in a surgery. Furthermore, this design is not necessarily compact enough to fit into the relative tight spaces involved in surgical procedures.

Other anchoring methods include variations of the three methods discussed above, which either create an interference (frictional drag), a surface to surface binding (taper lock), or a mechanical clip or retainer.

However, all of the existing retention mechanisms suffer from drawbacks as set forth above. There is therefore a need for a retention mechanism that does not suffer from the aforementioned drawbacks.

SUMMARY OF THE INVENTION

An embodiment of the invention is directed to a self-retaining retention mechanism comprising a tool shaft having a longitudinal axis of rotation and a tip portion; and a plurality of spring components that are located partially within slots in the tip portion such that the spring components are present at an angle.

DESCRIPTION OF EXEMPLARY EMBODIMENTS

The disclosed invention is directed to a frictional drag interface (interference fit) type retention mechanism, with several advantages over the currently available designs and retention strategies.

In an embodiment of the invention, frictional drag is created by two metal spring wires protruding proud of the mating driver surfaces. These components are produced from a metal, which is typically harder than the screw they interface with, and thus wear is not an issue. Repeated exposures to both cleaning chemicals and the conditions (i.e., high temperature) experienced during steam sterilization do not affect the spring wires. Components that are easily affected by temperature changes, such as the plastic component mentioned earlier, typically show evidence of fatigue after several cleaning and sterilization cycles.

The spring wires do not simply create an interference fit, resulting in the bending of the wire elements, but the wires function more like a hinge mechanism. As the screw is introduced to the driver tip, the spring wires flex out of the path of the receiving screw while still maintaining pressure against the screw, thus holding it onto the driver tip. Screws easily slide onto the driver tip, but because of the angle in which the wires are mounted, the pull off strength is increased over that of the insertion. The wires are configured similarly as that of an arrow head or fish hook, such that the point enters easily, but resistance is generated as the screw is withdrawn. Since the resistance is from a "spring" wire that can hinge out of the way, the pull-off resistance is consistently of the proper force.

Manufacturing tolerances do not have to be maintained nearly as closely as with other designs, because of the forgiveness of the spring/hinge mechanism.

In an embodiment of the invention, the mechanism is used on a hexalobular (Torx) driver tip. In an embodiment of the invention, the driver consists of a U-jointed driver with a modular handle. It should be recognized that the retention mechanism can easily be incorporated into almost any male-female driver tip interface, and any form of a driver, including but not limited to, straight handle, modular handle, non U-jointed, and ratcheting.

Figure 1A:
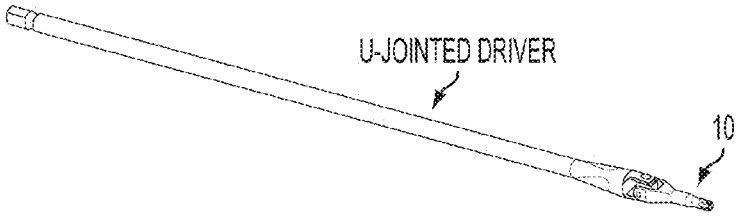
FIG. 1A shows the placement of a retention mechanism in a U-Joint driver in accordance with an embodiment of the invention.
Figure 1B:
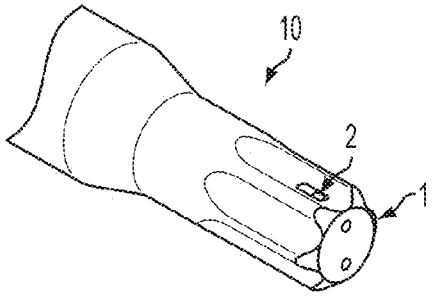
FIG. 1B shows a close-up view of the retention mechanism and driver tip in FIG. 1A in accordance with an embodiment of the invention.

In an embodiment of the invention, the inventive retention mechanism is incorporated into a typical U-joint driver. FIG. 1A shows the placement of the retention mechanism 10 in a U-Joint driver. FIG. 1B shows a close-up view of the retention mechanism 10 where 1 represents an enlarged view of the hexalobular (Torx) driver tip, and 2 represents one of the two spring wire elements or spring pins.

Figure 2A:
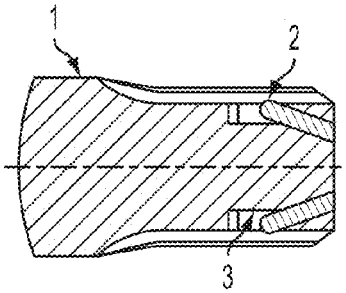
FIG. 2A shows a cross-sectional view of the driver tip in accordance with an embodiment of the invention.
Figure 2B:
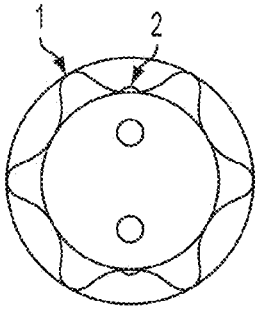
FIG. 2B shows a top view of the driver tip in accordance with an embodiment of the invention.

The hexalobular (Torx) driver tip is manufactured to industry standards in regard to size and shape of the hexalobular geometry. Two bores are produced through the tip at an angle that allows the spring pins 2 to protrude into a slot 3 and into the bottom path of the hexalobular geometry (FIGS. 2A and 2B). The spring pins are pressed into the angled bores and then welded in place at the most distal portion of the driver. The exposed tips of the spring wires that protrude into the hexalobular feature are spherically rounded to avoid scratching surfaces on the screw when it is loaded onto the driver.

Figure 3:
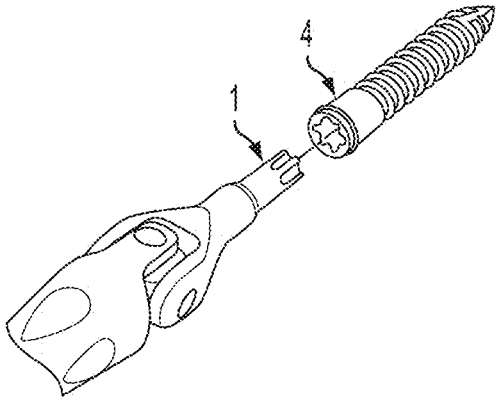
FIG. 3 shows a screw in position and about to be loaded onto the driver tip in accordance with an embodiment of the invention.
Figure 4:
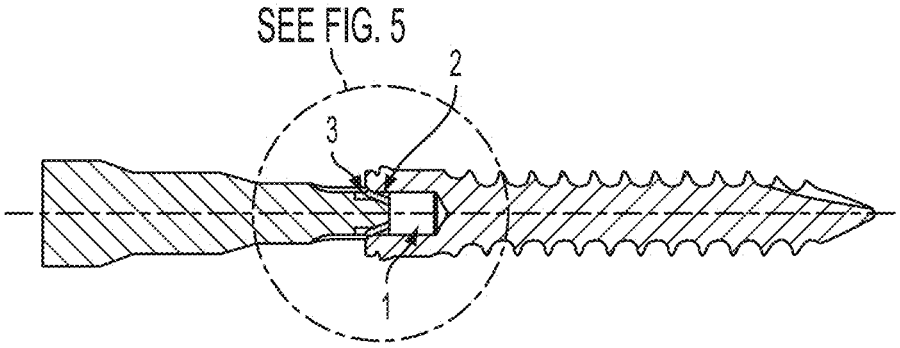
FIG. 4 shows the driver tip sliding into the screw in accordance with an embodiment of the invention.

FIGS. 3 and 4 depict the function of the driver tip and how it interfaces with a typical screw. FIG. 3 depicts a typical screw 4 in position and about to be loaded onto the driver tip 1. FIG. 4 depicts the driver tip 1 sliding into the screw 2.

Figure 5:
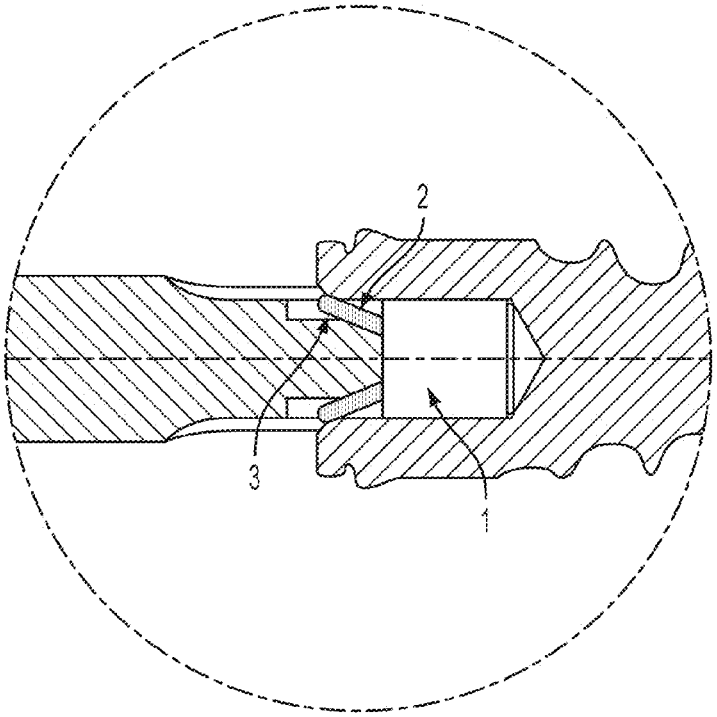
FIG. 5 shows the interaction between the driver tip and the screws in accordance with an embodiment of the invention.
Figure 6:
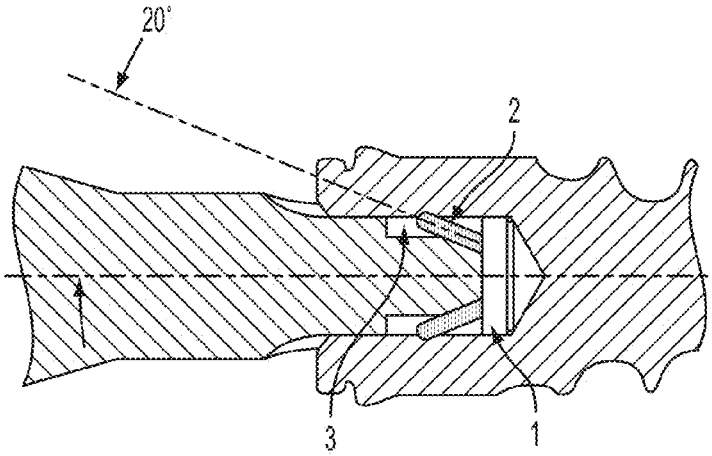
FIG. 6 shows the driver tip fully seated into a screw in accordance with an embodiment of the invention.

As shown in FIG. 5, the hexalobular geometry of the screw 2 is beginning to interfere with the spring wires 3. As the driver tip 1 continues deeper into the screw 2, the spring wires 3 flex downward towards the centerline of the driver tip 1, which creates a load on the spring wires 3 as they position into a constrained position (e.g., less than the 20°). FIG. 6 depicts the driver tip 1 fully seated into the screw 2. The nature of a spring is that it is always wanting to "spring" back to its unconstrained condition. This energy is what creates a repeatable and consistent force against the screw, and therefore holds the screw to the tip of the driver.

The angle of the spring wires 3, visible in FIG. 6, allows for the driver tip 1 and screw 2 to slide together easily. This angle of the spring wires 3 further depicts the earlier description from above, in the spring wires 3 were compared to that of an arrow head or a fish hook, which design helps prevent accidental disassociation of the spring wire from the screw.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are with the scope of this disclosure.

What is claimed is:

1. A self-retaining screw driver, comprising:

a tool shaft having a longitudinal axis of rotation and a tip portion, where the tip portion comprises:

a plurality of slots disposed in a side of the tip portion;

a plurality of wires, wherein each wire of the plurality of wires starts at an end of the tip portion, extends through one slot of the plurality of slots, and terminates outside of the slot.

2. The self-retaining screw driver of claim 1, wherein the tip portion interfaces with a screw by creating a resistance between the spring components and the surface of the screw.

3. The self-retaining screw driver of claim 1, wherein the resistance between the spring components and the surface of the screw holds the screw to the tip of the screwdriver.

4. The self-retaining screw driver of claim 3, wherein the resistance creates a repeatable and consistent force between the screw driver and the screw.

5. The self-retaining screw driver of claim 1, wherein the angle of the spring components causes the pull off strength to be increased over that of the insertion.

6. The self-retaining screw driver claim 1, wherein ends of the plurality of wires that terminate outside of the slot are spherically rounded.

7. The self-retaining screw driver of claim 1, wherein each wire of the plurality of wires is welded to the first end of the shaft.

8. The self-retaining screw driver of claim 1, further comprising:

a plurality of bores, wherein each bore of the plurality of bores extends from the end of the tip portion to one slot of the plurality of slots; and wherein each wire of the plurality of wires extends through one bore of the plurality of bores.

9. The self-retaining screw driver of claim 1, wherein each bore of the plurality of bores is angled relative to the longitudinal axis of rotation of the tool shaft.

10. A screw retention device, the device comprising:

a shaft comprising a first end and a second end;

a first slot and a second slot that are equally spaced about a periphery of the shaft;

a first bore that extends from the first end of the shaft to the first slot and a second bore that extends from the first end of the shaft to the second slot;

a first wire disposed within the first bore, wherein the first wire comprises a first end that terminates at an end of the first bore that is near the first end of the shaft and a second end that extends out of the first slot; and a second wire disposed within the second bore, wherein the second wire comprises a second end that terminates at an end of the second bore that is near the first end of the shaft and a second end that extends out of the first slot.

11. The device claim 10, wherein the second ends of the first and second wires comprise spherically rounded ends.

12. The device of claim 10, wherein the first ends of the first and second wires are welded to the first end of the shaft.

13. The device of claim 10, wherein the first and second bores are angled relative a center line of the shaft.

* * * * *